US005244347A

United States Patent [19]

Gallivan et al.

[11] Patent Number: 5,244,347

[45] Date of Patent: Sep. 14, 1993

[54] HIGH EFFICIENCY, LOW NOISE, AXIAL FLOW FAN

[75] Inventors: William P. Gallivan; Haran K. Periyathamby, both of London, Canada

[73] Assignee: Siemens Automotive Limited, Chatham, Canada

[21] Appl. No.: 775,163

[22] Filed: Oct. 11, 1991

[51] Int. Cl.[5] ..... F04D 29/32; F04D 29/52

[52] U.S. Cl. ..... 416/189; 416/169 A; 416/242; 415/208.2; 415/211.2; 415/220

[58] Field of Search ..... 416/169 A, 179, 189, 416/192, 238, 242; 415/119, 173.6, 208.1, 208.2, 211.2, 220, 223; 123/41.49

[56] References Cited

U.S. PATENT DOCUMENTS

| | | | |
|---|---|---|---|
| 2,785,009 | 3/1957 | Stocking | 416/189 R |
| 3,189,982 | 6/1965 | Merz | 416/192 |
| 3,201,857 | 8/1965 | Klonoski | 416/192 |
| 3,321,931 | 5/1967 | Lehmkuhl | 415/119 |
| 4,505,641 | 3/1985 | Tsuchikawa et al. | 416/169 A |
| 4,568,242 | 2/1986 | Susa et al. | 416/169 A |
| 4,685,513 | 8/1987 | Longhouse et al. | 416/189 R |
| 4,915,588 | 4/1990 | Brackett | 416/242 |

FOREIGN PATENT DOCUMENTS

| | | | |
|---|---|---|---|
| 2924568 | 1/1981 | Fed. Rep. of Germany | 415/208.1 |
| 2281043 | 3/1976 | France | 416/169 A |
| 284486 | 4/1931 | Italy | 416/189 R |

*Primary Examiner*—Edward K. Look
*Assistant Examiner*—James A. Larson
*Attorney, Agent, or Firm*—George L. Boller; Russel C. Wells

[57] ABSTRACT

The fan has an outer circular band that is spaced axially rearwardly of the hub. Forwardly skewed blades extend between the band and hub. Each blade has a radially intermediate portion that has reverse curvatures, namely a radially inner section curving about a location that is axially rearwardly of the blade and a radially outer section curving about a location that is axially forwardly of the blade. The fan is disposed within an aperture of a shroud having a central mount for an electric motor that drives the fan. The shroud has radial members that extend from the edge of the shroud aperture to the hub and that contain an axial offset.

15 Claims, 4 Drawing Sheets

| SECTION (FRONT VIEW) | R (mm) | C (mm) | θ (deg) | ε (deg) | Y OFFSET (mm) | ϕ SKEW (deg) |
|---|---|---|---|---|---|---|
| A | 72.5 | 44.0 | 27 | 69.61 | 0.00 | 16.0 |
| B | 77.0 | 46.0 | 22 | 71.08 | 0.00 | 16.0 |
| C | 96.3 | 40.0 | 15 | 74.53 | 8.00 | 14.0 |
| D | 115.5 | 31.0 | 15 | 74.95 | 10.00 | 13.5 |
| E | 134.8 | 30.0 | 14 | 74.31 | 5.00 | 10.0 |
| F | 154.0 | 30.0 | 14 | 71.76 | -7.00 | 7.5 |
| G | 173.3 | 30.0 | 15 | 68.36 | -18.56 | -2.5 |
| H | 182.9 | 30.0 | 14 | 70.01 | -18.26 | -0.5 |
| I | 190.8 | 29.0 | 14 | 71.42 | -18.40 | -7.5 |

R: RADIAL DISTANCE FROM CENTER OF HUB (mm)
C: CHORD LENGTH (mm)
θ: CAMBER ANGLE (degrees)
ε: STAGGER ANGLE ( degrees)
Y OFFSET: OFFSET FROM BACK OF HUB (mm)
ϕ: SKEW ANGLE of blade leading edge

HIGH EFFICIENCY, LOW NOISE, AXIAL FLOW FAN

FIELD OF THE INVENTION

This invention relates to one-piece fans of the type that are used in cooling modules of automotive vehicles for moving cooling air through heat exchangers of the vehicle, i.e. the engine radiator and/or the air conditioning condenser.

BACKGROUND AND SUMMARY OF THE INVENTION

From previously published patent documents, it is known to construct a one-piece fan that has a hub, a plurality of forwardly skewed blades that extend radially outwardly from the hub to a circular band that surrounds the hub. It is further known to dispose a shroud in surrounding relation to said band so that said fan rotates within the shroud.

It is also known to employ such a fan/shroud combination in a cooling module of an automotive vehicle, and in that case to construct the shroud with integral members that extend radially inwardly from the shroud to an integral electric motor mount for an electric motor that rotates the fan. These integral members are spaced axially from the fan blades so as to avoid mechanical interference therewith.

The design of any given automotive vehicle may impose dimensional constraints on a cooling module such that it may not be possible to use known axial flow fan constructions that possess high efficiency and low noise. Accordingly, there is a need for such fans that can be packaged within increasingly stricter dimensional constraints, and the present invention relates to the satisfaction of this need through novel and unique constructions for both the fan and the shroud. Details of a specific example of a fan and shroud embodying principles of the invention will be hereinafter described with reference to the accompanying drawings. The drawings disclose a presently preferred embodiment according to the best mode contemplated at the present time for carrying out the invention.

DESCRIPTION OF THE PREFERRED EMBODIMENT

Figure 1:
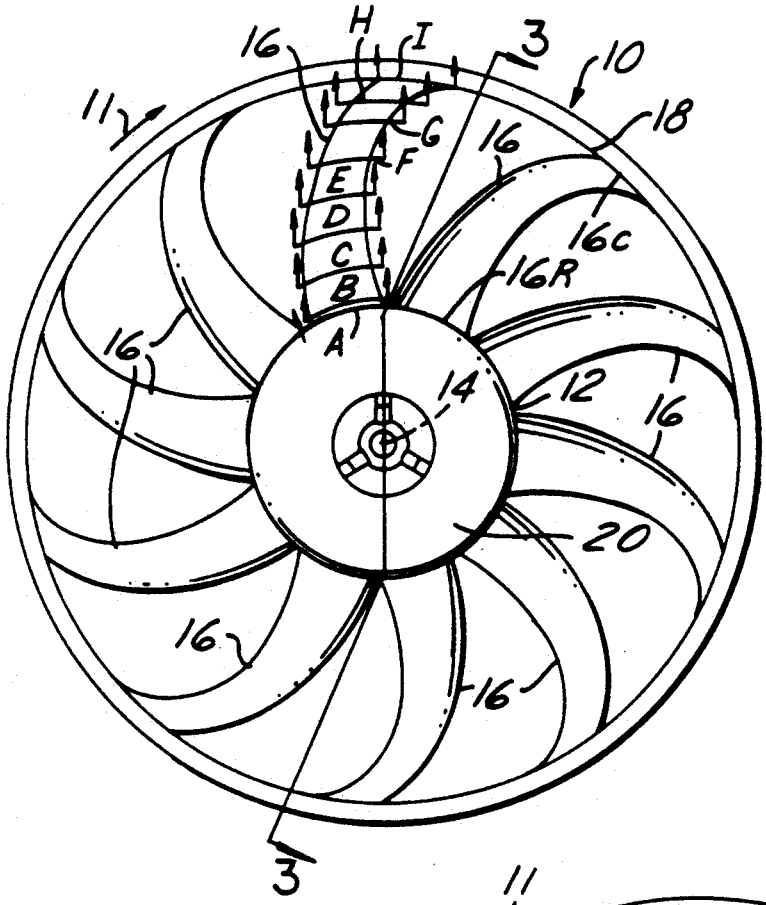
FIG. 1 is a front axial end view of a fan embodying principles of the invention.
Figure 2:
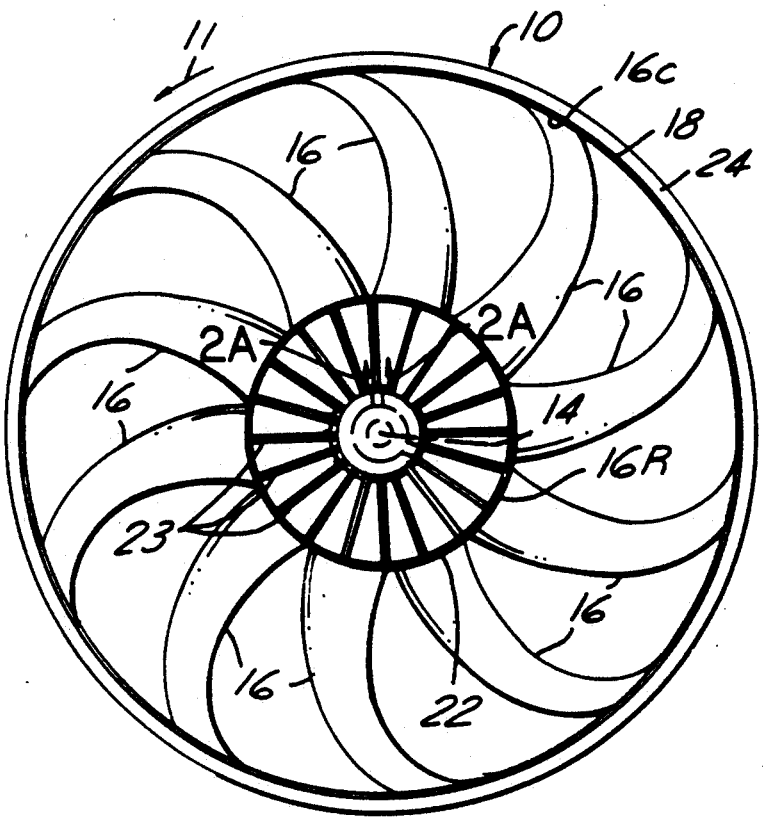
FIG. 2 is a rear axial end view of the fan of FIG. 1.
Figure 2A:
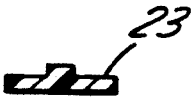
FIG. 2A is a cross sectional view on an enlarged scale in the direction of arrows 2A—2A in FIG. 2.

FIGS. 1, 2, 2A, and 3 illustrate an exemplary one-piece high efficiency, low noise, axial flow fan 10 embodying principles of the invention. Fan 10 comprises a hub 12 that supports the fan for rotation about an axis 14, a plurality of identical blades 16 (ten in the exemplary fan) symmetrically arranged around hub 12, and a circular outer band 18. A number (twenty in the exemplary fan) of stiffening ribs 23 are integrally formed on the interior of the hub as shown.

Hub 12 comprises a circular end wall 20 and a circular side wall 22. At its center, end wall 20 is configured to provide accommodations for mounting of the fan to the shaft of an electric motor (hereinafter described).

Blades 16 are arranged in a uniform symmetrical pattern around the hub. Each blade is forwardly skewed and has a root 16R joining with side wall 22 of hub 12 and a crest 16C that joins with band 18.

Band 18 has a axial dimension equal to or just slightly greater than the axial dimension of each blade, and includes a radial flange 24 that extends outwardly at the axially forward edge of the band.

Figure 3:
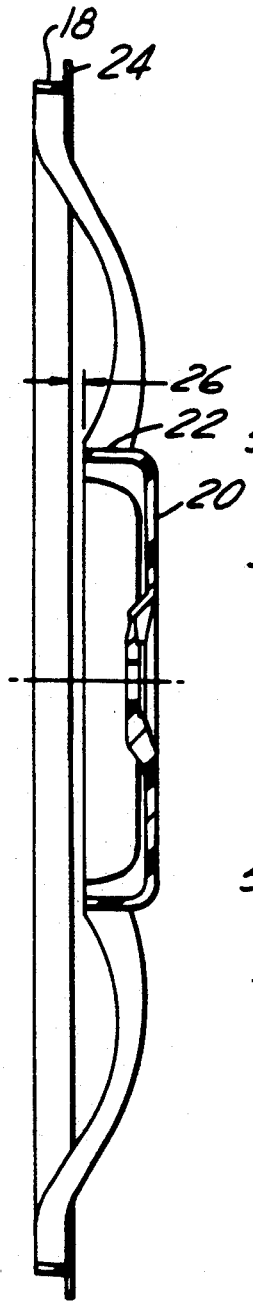
FIG. 3 is a cross sectional view, portions being broken away, taken in the direction of arrows 3—3 in FIG. 1.

As can be best seen in FIG. 3, band 18 is spaced axially of hub 12 such that the band does not circumferentially surround the hub, but rather a projection of the band onto axis 14 along a direction that is perpendicular to axis 14 does not intercept any portion of the hub. As also seen in FIG. 3, the band is disposed rearwardly of the hub by a distance 26.

As further seen in FIG. 3, each blade 16 has a radially inner portion that extends axially forwardly and radially outwardly from the hub and a radially outer portion that extends axially rearwardly and radially outwardly from the radially inner portion to join with band 18. As further seen looking in the circumferential direction, each blade comprises a radially intermediate portion that joins the corresponding radially inner and radially outer portions and that itself comprises adjoining curved sections, the radially outer one of which curves about a location that is axially forward of the blade, and the radially inner one of which curves about a location that is axially rearward of the blade.

Figure 4:
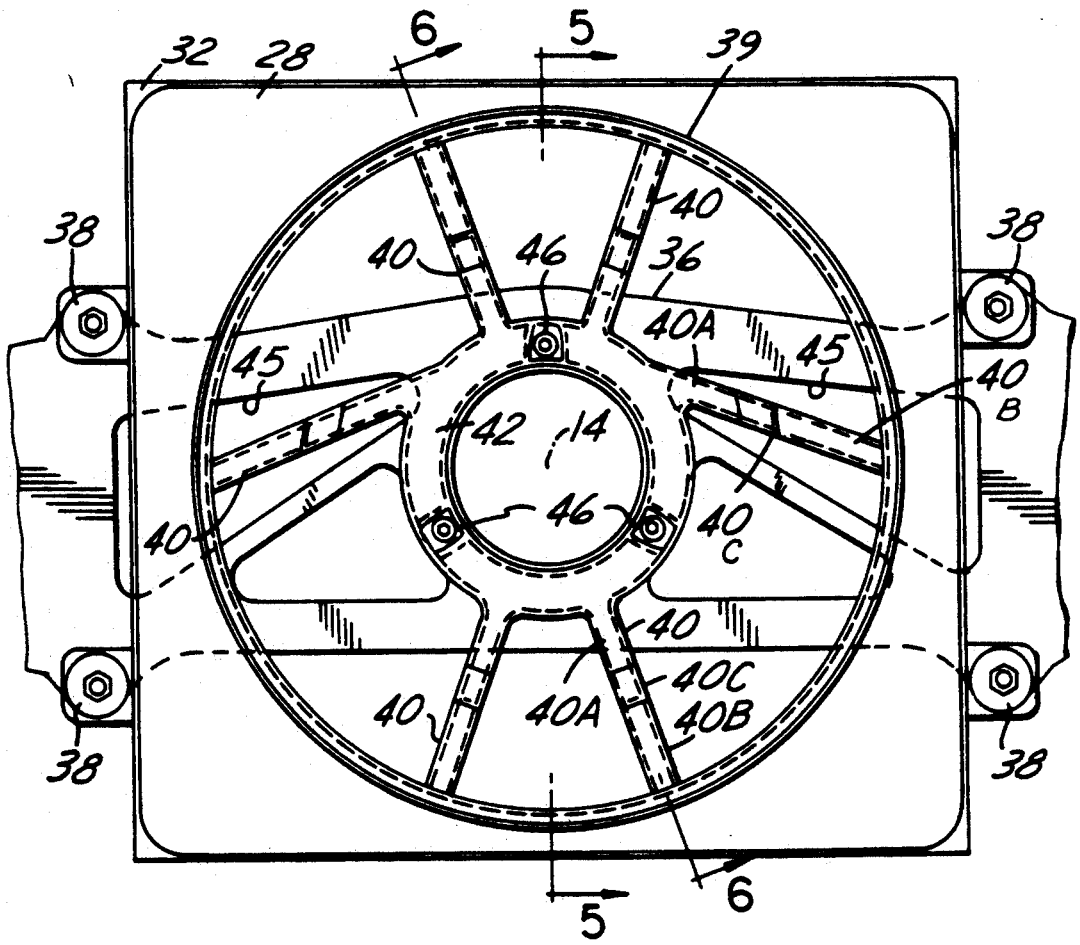
FIG. 4 is a front axial view of a shroud, excluding the fan, embodying principles of the invention.
Figure 5:
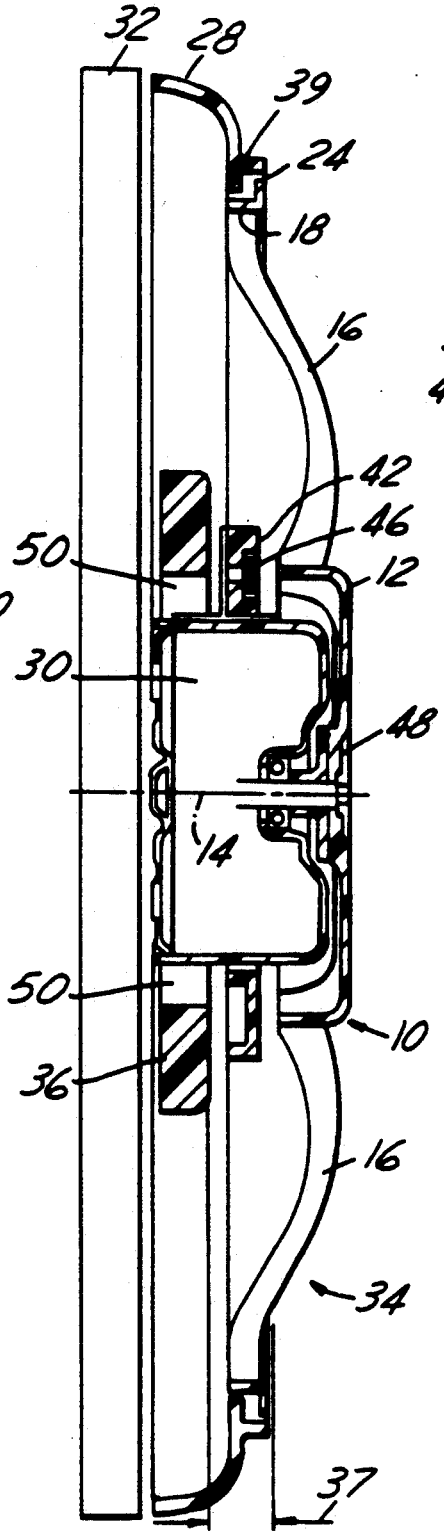
FIG. 5 is a cross sectional view taken in the direction of arrows 5—5 in FIG. 4, and including portions of the fan.
Figure 6:
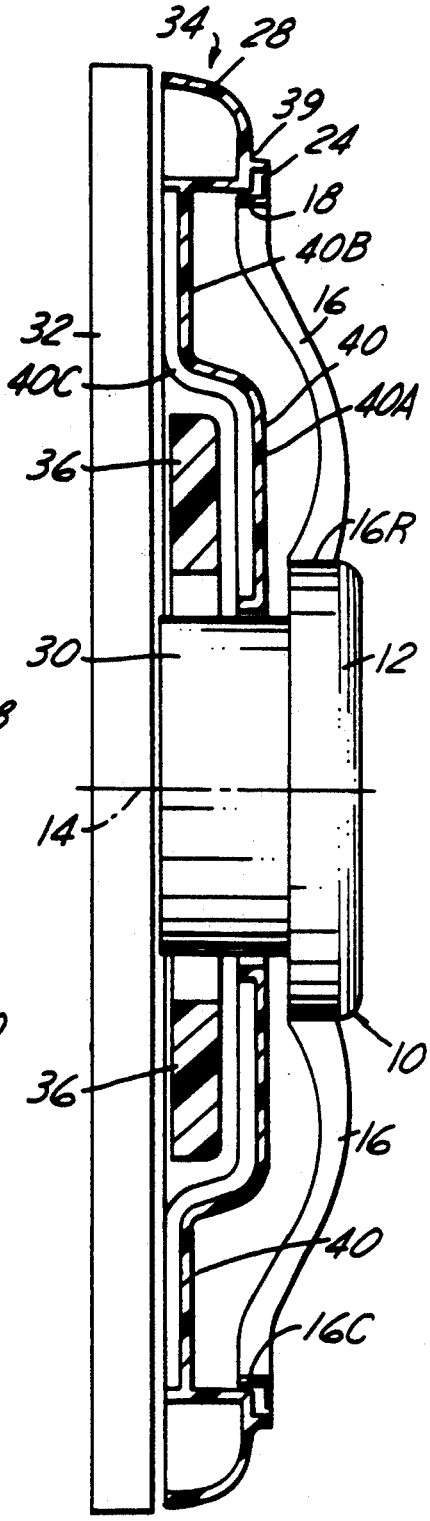
FIG. 6 is a cross sectional view taken in the direction of arrows 6—6 in FIG. 4, and including portions of the fan.

FIGS. 5–6 illustrate fan 10 in an operative association with a one-piece shroud 28, an electric motor 30 and a heat exchanger 32 to form a cooling module 34. Further details of shroud 28 also appear in FIG. 4. The cooling module is disposed on an automotive vehicle heat exchanger 32 connected in a liquid cooling circuit of a system, such as the engine cooling system, or the vehicle air conditioning system. Thus, heat exchanger 32 can represent either or both of the engine radiator and the air conditioning condenser. The illustrative automotive vehicle has a structural beam 36 that provides for the mounting of cooling module 34 on the vehicle. The points of attachment are designated by the numerals 38 in FIG. 4.

Shroud 28 comprises a fan-surrounding portion 39 that is shaped for cooperation with band 18 and flange 24 in a conventional manner to form an air seal between the outer perimeter of the fan and the shroud as the fan rotates about axis 14 within the surrounding shroud. The shroud also integrally comprises six members 40 that extend radially inwardly from the fan surrounding portion of the shroud to an integral mount 42 for electric motor 30. Motor 30 fastens to mount 42 at the three mounting locations designated by the reference numerals 46. The motor has a shaft 48 that points axially forwardly coaxial with axis 14, and the motor mounting accommodations in end wall 20 of hub 12 provide for the fan to be fitted onto and secured to the external end of shaft 48 so that the fan is rotated in unison with the rotation of shaft 48 when motor 30 is operated.

From consideration of FIGS. 4,5, and 6 it can be seen that beam 36 has a central void space 50 that provides clearance for the axially rearward portion of the electric motor housing, but the extent to which the motor can be disposed rearwardly in the cooling module is limited by the presence of heater exchanger 32. Because a dimensional constraint is imposed on the available axial distance between beam 36 and another portion of the surrounding structure of the vehicle around an outer circumferential marginal portion of the fan and shroud, heretofore known high efficiency, low noise, axial flow fans and associated shrouds cannot be used. The present invention provides a solution to this problem through unique constructions for the fan and shroud.

Members 40 are arranged to have other than a straight radial shape. Thus, as can be seen particular in FIG. 6 each member 40 has a radially inner portion 40A that extends substantially straight away from mount 42, a radially outer portion 40B that extends substantially straight away from shroud 28 and is non-coaxial with the radially inner portion, and a radially intermediate portion 40C that extends between the radially inner and outer portions. A radially inner and outer portions of each of four of the members are arranged to be substantially radial to axis 14 as viewed in FIG. 4. These four members are at the one, five, seven, and eleven o'clock positions. The remaining two members 40 are arranged to be substantially non-radial to axis 14 as viewed along that axis.

The result of the constructions that have been described for both members 40 and blades 16 is that each blade is disposed sufficiently axially forwardly of each member along the radial extent of each blade that the passage of each blade past each member does not create unacceptably high turbulence that is detrimental to the desired objectives of high efficiency and low noise. The combination of the six members 40 as shown provides structural support for the motor mount, including the motor and fan. The non-radial arrangement of the two members 40 at roughly the two-three and nine-ten o'clock positions allows the location of their axial offsetting portions 40C to be placed frontally of triangular-shaped voids 45 in beam 36 so that potential interference with the beam is avoided.

Figures 7, 8:
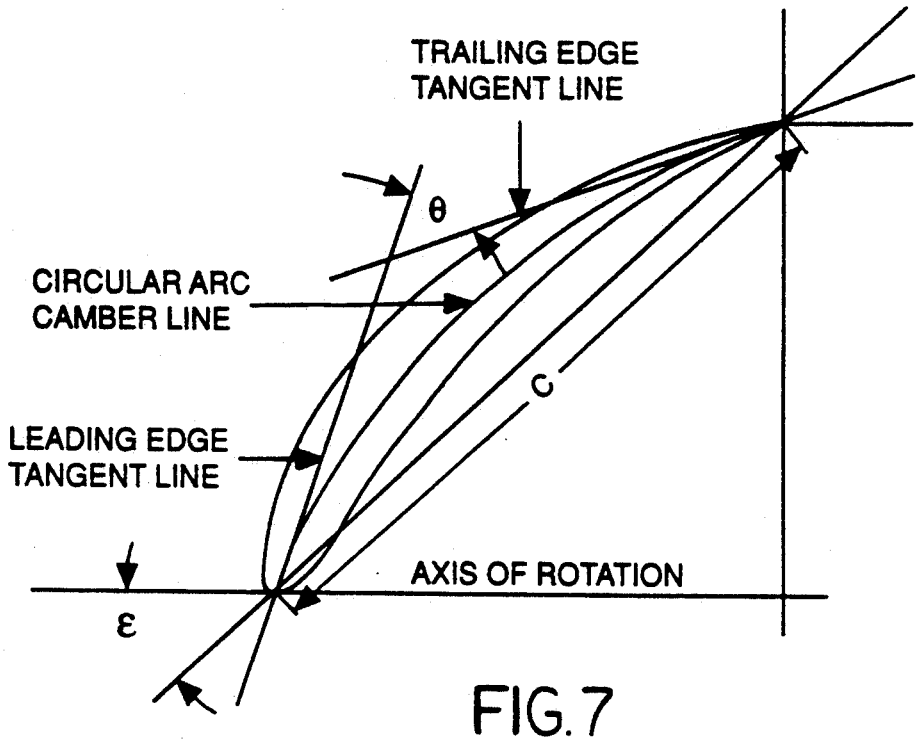
FIG. 7 is a cross sectional view, on an enlarged scale, through a portion of a blade for the purpose of presenting certain parameters that are used to define the blade of the example.
FIG. 8 is a chart presenting specific values for the defining parameters identified in FIG. 7 for the exemplary blade.

As shown in FIG. 7 each blade has the shape of an airfoil that can be defined geometrically by several parameters. These parameters are graphically portrayed in FIG. 7 in relation to a representative airfoil cross section. For the specific example of fan that is illustrated in FIGS. 1-3, FIG. 8 provides numerical values of these parameters. The airfoil-shaped cross section of a blade is taken at a number of radial distances R as measured radially from axis 14 These radial distances are designated by the letters A-I in both FIGS. 1 and 8. The Y offset is the axial offset distance of the trailing edge of the circular arc camber line measured from the back of the hub. Positive values of the Y offset are forward while negative values are rearward.

The numerical values of the parameters defining each blade of the example provide a noticeable noise attenuation at a particular rotational speed of the fan, namely the normal fan operating speed in the case of a single speed motor 30. The shape of the blades also provides stiffness in the Y direction which is beneficial in minimizing noise and enabling the fan to move air efficiently from the forward high pressure region to the rearward low pressure region which exists across the fan when it is being rotated by motor 30. The fan and shroud of the invention provide high efficiency, low noise performance despite the dimensional constraint that has been imposed and despite the partial obstruction that is presented by the presence of beam 36.

The numerical values presented in FIG. 8 for the exemplary fan can be converted into non-dimensional form as an aid to employment of the inventive principles in designing other exemplary fans.

What is claimed is:

1. A one-piece high efficiency, low noise, axial flow fan comprising a hub that is rotatable about an axis, a plurality of forwardly skewed, airfoil-shaped fan blades distributed circumferentially around said hub and extending both radially and axially away from said hub, each blade having a root joining with said hub, said fan having a circular band that is concentric with and spaced radially outwardly from said hub, each blade having a crest joining with said band, and said band being spaced axially of said hub such that said band does not circumferentially surround said hub, but rather a projection of said band onto said axis along a direction that is perpendicular to said axis does not intercept any portion of said hub, and each blade having a radially inner portion extending radially outwardly from said hub, a radially outer portion extending radially inwardly from said band, and a radially intermediate portion that joins the corresponding radially inner and outer portions and that as viewed in the circumferential direction, comprises adjoining curved sections, a radially outer of said curved sections curving about a location that is axially forward of the blade, and a radially inner of said curved sections curving about a location that is axially rearward of the blade.

2. A fan as set forth in claim 1 in which said band is disposed axially rearwardly of said hub.

3. A fan as set forth in claim 1 including a shroud which is disposed in circumferentially surrounding radially outwardly spaced cooperative relation to said band and within which said fan is relatively rotatable about said axis.

4. A fan including a shroud as set forth in claim 3, said shroud including a plurality of members which are circumferentially shaped apart said axis and project radially inwardly of said shroud to an electric motor mount for mounting an electric motor that rotates said fan, each of said members comprising a radially inner portion that extends substantially straight away from said electric motor mount, a radially outer portion that extends substantially straight away from said shroud and is non-coaxial with its member's radially inner portion such that it is axially rearwardly offset relative to its member's radially inner portion, and a radially intermediate portion that extends between said radially inner and radially outer portions.

5. A fan including a shroud as set forth in claim 4 in which said radially inner and radially outer portions of each member are arranged to be substantially radial to said axis as viewed in the direction of said axis.

6. A fan including a shroud as set forth in claim 4 further including additional members that are like the first-mentioned members except that said radially inner and radially outer portions of each of said additional members are arranged to be substantially non-radial to said axis as viewed in the direction of said axis.

7. A one-piece high efficiency, low noise, axial flow fan comprising a hub that is rotatable about an axis, a plurality of forwardly skewed, airfoil-shaped fan blades distributed circumferentially around said hub and extending both radially and axially away from said hub, each blade having a root joining with said hub, said fan having a circular band that is concentric with and spaced radially outwardly from said hub, each blade having a crest joining with said band, and said band being spaced axially of said hub such that said band does not circumferentially surround said hub, but rather a projection of said band onto said axis along a direction that is perpendicular to said axis does not intercept any portion of said hub including a shroud which is disposed in circumferentially surrounding radially outwardly spaced relation to said band and within which said fan is relatively rotatable about said axis, said shroud including a plurality of members which are circumferentially spaced apart about said axis and project radially inwardly of said shroud to an electric motor mount for mounting an electric motor that rotates said fan, each of said members comprising a radially inner portion that extends substantially straight away from said electric motor mount, a radially outer portion that extends substantially straight away from said shroud and is non-coaxial with its member's radially inner portion such that it is axially rearwardly offset relative to its member's radially inner portion, and a radially intermediate portion that extends between said radially inner and radially outer portions.

8. A fan including a shroud as set forth in claim 7 in which said radially inner and radially outer portions of each member are arranged to be substantially radial to said axis as viewed in the direction of said axis.

9. A fan including a shroud as set forth in claim 7 further including additional members that are like the first-mentioned members except that said radially inner and radially outer portions of each of said additional members are arranged to be substantially non-radial to said axis as viewed in the direction of said axis.

10. A one-piece high efficiency, low noise, axial flow fan comprising a hub that is rotatable about an axis, a plurality of forwardly skewed, airfoil-shaped fan blades distributed circumferentially around said hub and extending both radially and axially away from said hub, each blade having a root joining with said hub, said fan having a circular band that is concentric with and spaced radially outwardly from said hub, each blade having a crest joining with said band, and said band being spaced axially of said hub such that said band does not circumferentially surround said hub, but rather a projection of said band onto said axis along a direction that is perpendicular to said axis does not intercept any portion of said hub in which each of said blades is constructed substantially in accordance with the parameters defined by

| R (mm) | C (mm) | θ (deg) | Σ (deg) | Yoffset (mm) | Φ SKEW (deg) |
|---|---|---|---|---|---|
| 72.5 | 44.0 | 27 | 69.61 | 0.00 | 16.0 |
| 77.0 | 46.0 | 22 | 71.08 | 0.00 | 16.0 |
| 96.3 | 40.0 | 15 | 74.53 | 8.00 | 14.0 |
| 115.5 | 31.0 | 15 | 74.95 | 10.00 | 13.5 |
| 134.8 | 30.0 | 14 | 74.31 | 5.00 | 10.0 |
| 154.0 | 30.0 | 14 | 71.76 | −7.00 | 7.5 |
| 173.3 | 30.0 | 15 | 68.36 | −18.56 | 2.5 |
| 182.9 | 30.0 | 14 | 70.01 | −18.26 | −0.5 |
| 190.8 | 29.0 | 14 | 71.42 | −18.40 | −7.5 |

wherein:

R is the radial distance from center of hub (mm),

C is the chord length (mm) of the airfoil at the radial distance R,

θ is the chamber angle (degrees) of the airfoil at the radial distance R,

Σ is the Stagger angle (degrees) of the airfoil at the radial distance R,

Yoffset is the offset of the trailing edge of the airfoil from back of hub (mm) at the radial distance R, and ϕ is the blade leading edge skew angle (degrees) at the radial distance R.

11. A shroud which in use is disposed in circumferentially surrounding radially outwardly spaced relation to a radially outer band of a one-piece high efficiency, low noise, axial flow fan, within which said fan is relatively rotatable about an axis, said shroud comprising a plurality of members which are circumferentially spaced apart about said axis and project radially inwardly of said shroud to an electric motor mount for mounting an electric motor for rotating the fan, each of said members comprising a radially inner portion that extends substantially straight away from said electric motor mount, a radially outer portion that extends substantially straight away from said shroud and is non-coaxial with its member's radially inner portion, and a radially intermediate portion that extends between said radially inner and radially outer portions.

12. A shroud as set forth in claim 11 in which said radially inner and radially outer portions of each member are arranged to be substantially radial to said axis as viewed in the direction of said axis.

13. A shroud as set forth in claim 12 further including additional members that are like the first-mentioned members except that said radially inner and radially outer portions each of said additional members are arranged to be substantially non-radial to said axis as viewed in the direction of said axis.

14. A shroud as set forth in claim 11 further including an electric motor disposed in said mount, and such a one-piece high efficiency, low noise, axial flow fan that is rotated by said motor and that has such a radially outer band cooperatively associated in radially inwardly spaced relation to the circumferentially surrounding shroud.

15. A shroud as set forth in claim 11 in which said members are integrally formed with the shroud.

* * * * *